US008692677B2

(12) United States Patent
Wada et al.

(10) Patent No.: US 8,692,677 B2
(45) Date of Patent: Apr. 8, 2014

(54) WAKE-UP ASSISTING APPARATUS AND WAKE-UP ASSISTING METHOD

(75) Inventors: Seiji Wada, Kanagawa (JP); Takuro Yamamoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 160 days.

(21) Appl. No.: 13/289,344

(22) Filed: Nov. 4, 2011

(65) Prior Publication Data

US 2012/0133513 A1 May 31, 2012

(30) Foreign Application Priority Data

Nov. 25, 2010 (JP) ..... 2010-262979

(51) Int. Cl.
*G08B 23/00* (2006.01)

(52) U.S. Cl.
USPC ..... 340/575; 600/538; 600/544; 600/545; 600/595

(58) Field of Classification Search
USPC ..... 340/575; 600/538, 544, 545, 595
See application file for complete search history.

(56) References Cited

U.S. PATENT DOCUMENTS

| | | | | |
|---|---|---|---|---|
| 5,813,993 | A * | 9/1998 | Kaplan et al. | 600/544 |
| 2008/0177197 | A1* | 7/2008 | Lee et al. | 600/545 |
| 2011/0319721 | A1* | 12/2011 | Hamaguchi | 600/300 |

FOREIGN PATENT DOCUMENTS

| | | |
|---|---|---|
| JP | 2006-192152 | 7/2006 |

* cited by examiner

*Primary Examiner* — Tai T Nguyen
(74) *Attorney, Agent, or Firm* — K&L Gates LLP

(57) ABSTRACT

Disclosed herein is a wake-up assisting apparatus including: an electrode which comes into contact with the parietal of the human body; a signal processing part which detects brain waves through the electrode, determines the sleep stage from the thus detected brain waves, and decides the wake-up time according to the sleep stage; and a stimulating part which gives stimuli to the human body at the wake-up time.

7 Claims, 10 Drawing Sheets

FIG. 7

| SLEEP STAGE | | STATE | FEATURES |
|---|---|---|---|
| NON-SLEEP | WAKE | AWAKE | EEG : COMBINATION OF α-WAVE AND LOW-AMPLITUDE HIGH-FREQUENCY WAVE<br>EMG : HIGH-AMPLITUDE CONTINUOUS WAVE<br>ECG : REM (RAPID EYE MOVEMENT) |
| REM SLEEP | REM | REM SLEEP | EEG : WITH α-WAVE GRADUALLY DECREASING WITH TIME<br>EOG : REM<br>EMG : WITH A MINIMUM AMPLITUDE |
| NON-REM SLEEP | STAGE1 | FALLING SLEEP | EEG : WITH α-WAVE GRADUALLY DECREASING WITH TIME<br>EOG : SEM(Slow Eye Movement) |
| | STAGE2 | LIGHT SLEEP | EEG : SLEEP SPINDLE WAVE, K COMPOUND WAVE, WITHOUT HIGH-AMPLITUDE SLOW WAVE, δ-WAVE ACCOUNTING FOR NO HIGHER THAN 20%<br>EOG,EMG : APPEARING CONTINUOUSLY, LOW AMPLITUDE |
| | STAGE3 | MEDIUM SLEEP | EEG : δ-WAVE (NO HIGHER THAN 2Hz AND 75μV) ACCOUNTING FOR 20 TO 50%<br>EMG : CONTINUOUS WAVE WITH A LOWER AMPLITUDE THAN STAGE 2 |
| | STAGE4 | DEEP SLEEP | EEG : δ-WAVE (NO HIGHER THAN 2Hz AND 75μV) ACCOUNTING FOR NO LESS THAN 50%<br>EMG : SAME AS STAGE 3 |

WAKE-UP ASSISTING APPARATUS AND WAKE-UP ASSISTING METHOD

CROSS-REFERENCES TO RELATED APPLICATIONS

The present application claims priority to Japanese Priority Patent Application JP 2010-262979 filed in the Japan Patent Office on Nov. 25, 2010, the entire content of which is hereby incorporated by reference.

BACKGROUND

The present application relates to a wake-up assisting apparatus and a wake-up assisting method, which are designed to help the user to wake up according to his or her sleep state.

Human's sleep can be classified into several stages according to the degree of brain activity. Each of such stages is called "sleep stage." A sleep stage in which the body is resting but the brain is acting is referred to as REM (Rapid Eye Movement) sleep. It is distinguished from non-REM sleep (including several sleep stages) in which both the body and the brain are resting. A human is ready to wake up in the REM sleep state but is hard to wake up in the non-REM sleep state in which the brain takes a certain length of time for revival.

For the reason mentioned above, there is a need for a wake-up assisting apparatus which detects whether the user's sleep is REM sleep or non-REM sleep and wakes up the user (by giving stimuli for wake-up) according to the result of detection. Japanese Patent Laid-Open No. 2006-192152 (Paragraph 0018 and FIG. 2, hereinafter referred to as Patent Document 1), for example, discloses "Apparatus for determining sleep state" which detects the user's sleep state by means of a body movement sensor and a pulse sensor in combination.

SUMMARY

The apparatus disclosed in Patent Document 1 discriminates between REM sleep and non-REM sleep by utilizing such information as changes in body movement or pulses which would occur depending on the degree of brain activity. It does not determine the sleep state directly from brain activity. The sleep state affects body movements and pulses differently from one user to another. Such effects vary even in the same user depending on his or her body conditions. Thus, there would be an instance in which it is impossible to accurately determine the user's sleep state by utilizing the above-mentioned information.

The foregoing motivated the present application to provide a wake-up assisting apparatus and a wake-up assisting method, which are designed to help the user to wake up according to his or her sleep state.

According to one embodiment, the wake-up assisting apparatus is composed of an electrode, a stimulating part, and signal processing part.

The above-mentioned electrode is designed for contact with the user's head.

The above-mentioned signal processing part detects brain waves through the electrode, determines the sleep stage based on the thus detected brain waves, and decides the wake-up time based on the sleep stage.

The above-mentioned stimulating part gives stimuli to the user at the wake-up time.

The wake-up assisting apparatus acquires brain waves through the electrode in contact with the user's parietal and accurately determines the sleep stage that denotes the degree of the user's sleep. Therefore, it wakes up the user by giving stimuli through the stimulating part to the user according to his or her sleep state.

The above-mentioned signal processing part may be set up such that the time at which the REM sleep stage ends coincides with the wake-up time.

The REM sleep stage as one of the sleep stages is a stage in which the user wakes up more easily than in non-REM sleep stages. Therefore, the wake-up assisting apparatus according to an embodiment allows the user to wake up while the brain is in a state for easy wake-up.

The above-mentioned signal processing part may also be set up such that some of the times at which the REM sleep stage ends are regarded as candidates for wake-up time and one of them which is closest to the desirable wake-up time is made the actual wake-up time.

The wake-up assisting apparatus according to an embodiment decides the actual wake-up time from one of the candidates which is closest to the previously intended wake-up time. In this way it permits the user to wake up at the time for the brain to revive easily and at the time that allows the longest sleep time for the user.

The electrode and the signal processing part, which have been mentioned above, may be attached to the head gear to be mounted on the user's head.

The wake-up assisting apparatus is constructed such that the head gear is equipped with all the components necessary to measure brain waves, to determine the sleep stage, and to decide the wake-up time.

According to a further embodiment, the wake-up assisting apparatus mentioned above is further provided with a communication part which sends the brain waves to the signal processing part and receives the wake-up time from the signal processing part. The electrode, the communication part, and the stimulating part, which have been mentioned above, may be attached to the head gear to be mounted on the user's head.

The wake-up assisting apparatus may be composed of the head gear having the electrode, the communication part, and the stimulating part and the unit having the signal processing part independent of the head gear. The electrode measures brain waves and the information of brain waves is sent to the signal processing part by the communication part and the signal processing part decides the wake-up time. The wake-up time is sent to the communication part, so that the stimulating part gives stimuli to the user. The fact that the signal processing part is separate from the head gear permits weight saving for the head gear and usage of the signal processing part by more than one head gear.

According to a still further embodiment, the wake-up assisting apparatus mentioned above may be modified such that it additionally has the communication part to send the information of brain waves to the signal processing part mentioned above and the electrode and communication part mentioned above are attached to the head gear to be mounted on the user's head.

The wake-up assisting apparatus may be composed of the head gear having the electrode and the communication part and the unit having the signal processing part and the stimulating part independent of the head gear. The communication part sends the information of brain waves measured by the electrode to the signal processing part, which decides the wake-up time and sends it to the stimulating part. The stimulating part gives stimuli to the user. The fact that the stimulating part is separate from the head gear permits the stimulating part to be arranged freely at any position of the user.

According to one embodiment, the wake-up assisting method includes bringing the electrode into contact with the user's head, the signal processing part determining the sleep stage based on the information of brain waves detected through the electrode and deciding the wake-up time based on the sleep stage, and the stimulating part giving stimuli to the user at the wake-up time.

As mentioned above, the present application provides an apparatus and a method which help the user to wake up in response to his or her sleep stage by using the information of brain waves.

Additional features and advantages are described herein, and will be apparent from the following Detailed Description and the figures.

BRIEF DESCRIPTION OF THE FIGURES

FIG. 7 is a table showing the features (such as brain waves) which are used for determination of sleep stage by the signal processing part of the wake-up assisting apparatus in FIG. 1;

DETAILED DESCRIPTION

The present application will be described below with reference to the drawings according to the embodiment.

The following is a description of the first embodiment.

[Structure of the Wake-Up Assisting Apparatus]

Figure 1:
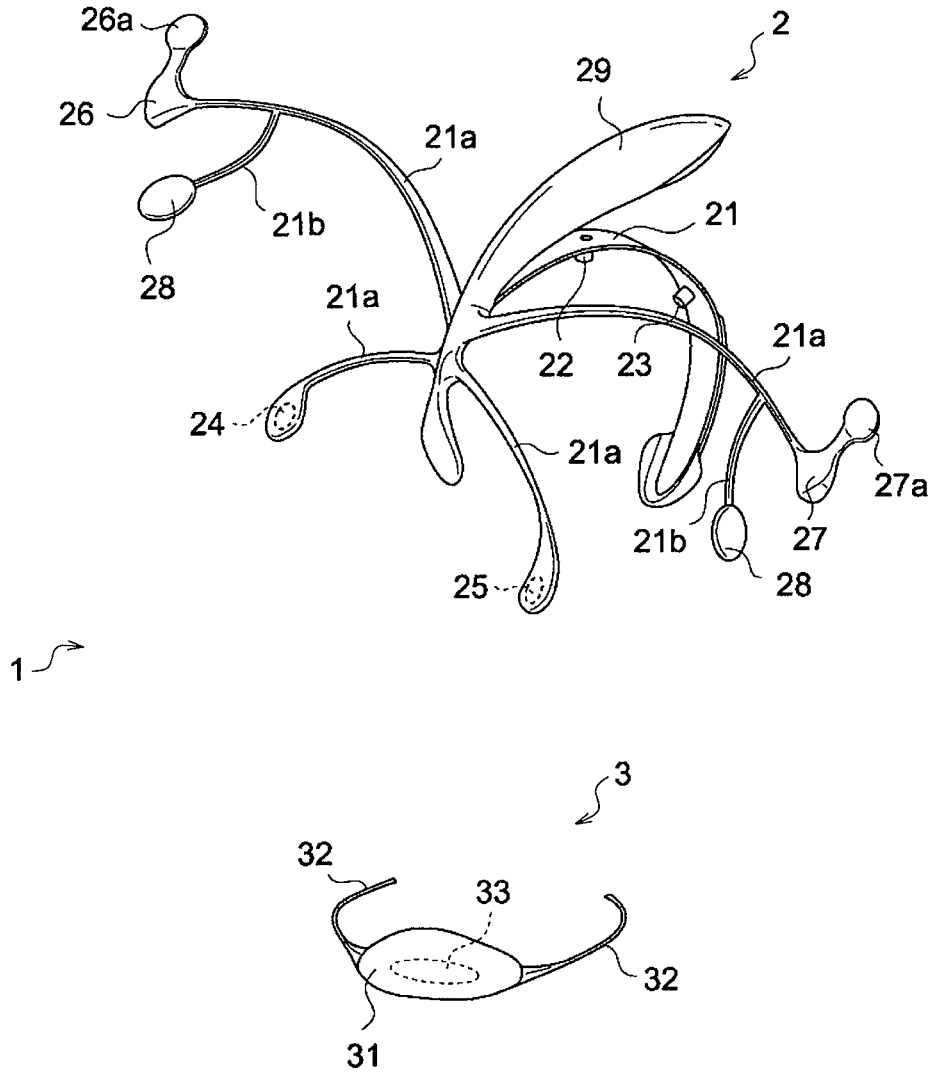
FIG. 1 is a perspective view showing the appearance of the wake-up assisting apparatus according to the first embodiment.

FIG. 1 is a perspective view showing the appearance of a wake-up assisting apparatus 1 according to the first embodiment. As shown in FIG. 1, the wake-up assisting apparatus is made up of a head brace 2 and a chin brace 3. The head brace 2 is to be mounted on the user's head, and the chin brace 3 is to be mounted on the user's chin.

The head brace 2 has a head band 21 to be supported on the user's head. The head band 21 is provided with a parietal electrode 22, an occipital electrode 23, a right electro-ocular electrode 24, a left electro-ocular electrode 25, a right reference electrode 26, a left reference electrode 27, and a stimulating part 28. The head band 21 is also provided with an enclosure that contains electronic components mentioned later.

The head band 21 is a member extending from the forehead to the parietal and occipital of the user. It takes on an arched shape that fits to the user's head. Moreover, the head band 21 holds the user's head with its elastic force. The head band 21 has four arms 21*a* supporting the right electro-ocular electrode 24, the left electro-ocular electrode 25, the right reference electrode 26, and the left reference electrode 27, correspondingly. The shape of the head band 21 may be properly varied.

The parietal electrode 22 comes into contact with the user's parietal; it may be a brush-like electrode made of conductive material, so that it moves hair aside to ensure contact with the skin. In addition, the parietal electrode 22 is positioned such that it comes into contact with the user's parietal when the head brace 2 is mounted on the user's head. The occipital electrode 23 comes into contact with the user's occipital; it may be a brush-like electrode made of conductive material as in the case of the parietal electrode 22. In addition, the occipital electrode 23 is positioned such that it comes into contact with the user's occipital when the head brace 2 is mounted on the user's head. The parietal electrode 22 and the occipital electrode 23 are intended to measure the user's brain waves (EEG: electroencephalogram).

The right electro-ocular electrode 24 comes into contact with the user's right temple, and it may be a flat electrode made of conductive material. The right electro-ocular electrode 24 is attached to the arm 21*a* extending from the head band 21 to the user's right temple when the user wears the head brace 2. Similarly, the left electro-ocular electrode 25 comes into contact with the user's left temple, and it may be a flat electrode made of conductive material. The left electro-ocular electrode 25 is attached to the arm 21*a* extending from the head band 21 to the user's left temple when the user wears the head brace 2. The right electro-ocular electrode 24 and the left electro-ocular electrode 25 are intended to measure the user's eye movement (EOG: electrooculogram).

The right reference electrode 26 comes into contact with the back of the user's earlobe, and it may be a flat electrode made of conductive material. The right reference electrode 26 is attached to the arm 21*a* extending from the head band 21 to the user's right ear when the user wears the head brace 2. The right reference electrode 26 has an earlobe holder 26*a* which holds the earlobe in conjunction with the right reference electrode 26 as it is positioned on the front of the earlobe. Similarly, the left reference electrode 27 comes into contact with the back of the user's earlobe, and it may be a flat electrode made of conductive material. The left reference electrode 27 is attached to the arm 21*a* extending from the head band 21 to the user's left ear when the user wears the head brace 2. The left reference electrode 27 has an earlobe holder 27*a* which holds the earlobe in conjunction with the left reference electrode 27 as it is positioned on the front of the earlobe.

The stimulating part 28 gives stimuli to the user. It is assumed to be paired right and left speakers which emit an alarm sound. The stimulating parts 28 are attached to arms 21*b* extending from the right and left arms 21*a*, so that they are positioned near the user's right and left ears when the user wears the head brace 2. As will be mentioned later, the stimuli to be given to the user from the stimulating part 28 are not restricted to sound, but they include light or fragrance. Thus the stimulating part may vary in structure depending on the type of stimuli it produces.

The enclosure 29 is attached to the head band 21 in such a way that the enclosure 29 permits the user to easily wear the head band 21. The enclosure 29 contains electronic components such as processor, memory, and communication interface, configuring a signal processing part which will be mentioned later. The head band 21 and the arms 21*a* and 21*b* are provided with wiring (not shown) for connection with the electrodes, electronic components, and stimulating part 28.

The chin brace 3 is made up of an enclosure 31 to be placed on the user's chin and arms 32 which fix the enclosure 31 onto the user's chin. The enclosure 31 contains an electrode 33 for chin electromyogram and electronic components such as communication interface.

The enclosure 31 is shaped so that it fits to the user's chin. The arms 32 are elastic members extending rightward and leftward from the enclosure 31. Each of them stretches from the cheek to the ear of the user, so that they fix the enclosure 31 onto the user's chin.

The electrode 33 for chin electromyogram comes into contact with the user's chin. It may be a curved flat electrode made of conductive material. The electrode 33 for chin electromyogram is connected to the communication interface contained in the enclosure 31. The electrode 33 for chin electromyogram is to measure the electromyogram (EMG).

[Functional Structure of the Wake-Up Assisting Apparatus]

Figure 2:
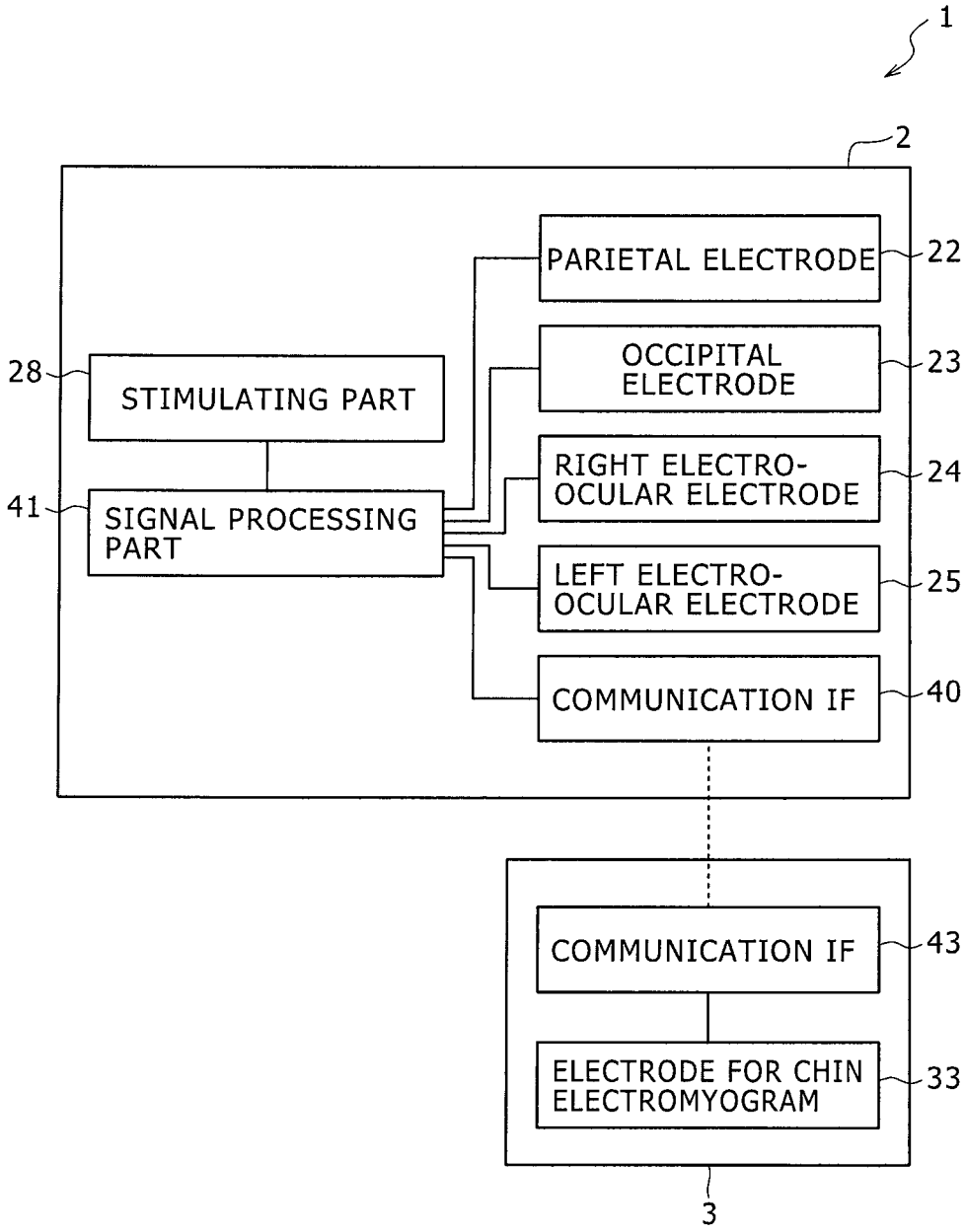
FIG. 2 is a block diagram illustrating the functional structure of the wake-up assisting apparatus in FIG. 1.

FIG. 2 is a block diagram illustrating the functional structure of the wake-up assisting apparatus 1.

As shown in FIG. 2, the head brace 2 is provided with the parietal electrode 22, the occipital electrode 23, the right electro-ocular electrode 24, the left electro-ocular electrode 25, the stimulating part 28, a communication interface (IF) 40, and a signal processing part 41. The parietal electrode 22, the occipital electrode 23, the right electro-ocular electrode 24, and the left electro-ocular electrode 25 are connected to the signal processing part 41. The signal processing part 41 is connected to the stimulating part 28.

The chin brace 3 has the electrode 33 for chin electromyogram and a communication interface (IF) 43. The electrode 33 for chin electromyogram is connected to the communication IF 43. The communication IF 43 of the chin brace 3 and the communication IF 40 of the head brace 2 are connected to each other through communication means such as wireless one.

The foregoing structure causes the parietal electrode 22, the occipital electrode 23, the right electro-ocular electrode 24, the left electro-ocular electrode 25, and the electrode 33 for chin electromyogram to send their output to the signal processing part 41. (These electrodes are collectively called the electrode group hereinafter.) The signal processing part 41 analyses these outputs to determine the sleep state (mentioned later) and decides the wake-up time (mentioned later) based on the sleep stage and sends this information to the stimulating part 28.

[Action of the Wake-Up Assisting Apparatus]

Figure 3:
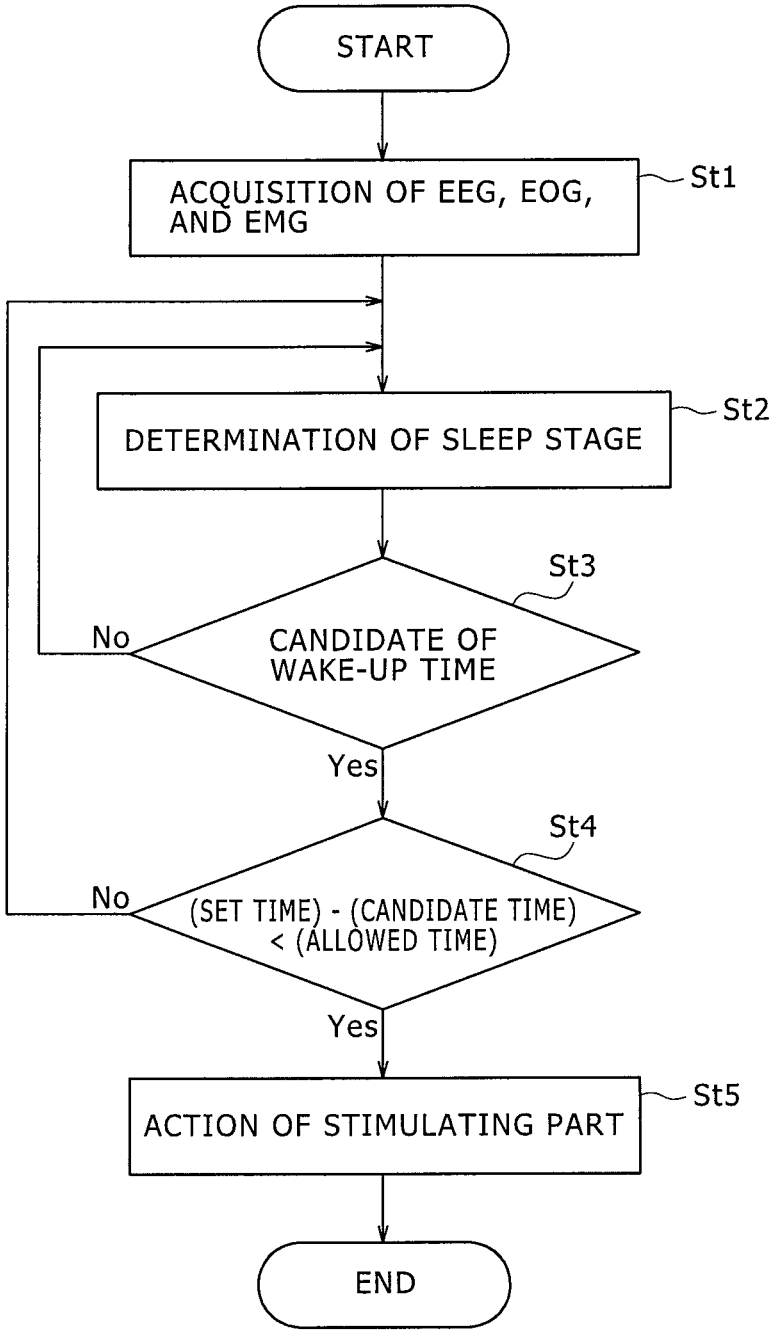
FIG. 3 is a block diagram illustrating the action of the wake-up assisting apparatus in FIG. 1.

FIG. 3 is a flow chart showing the action of the wake-up assisting apparatus 1. Each step (St) in this flow chart will be explained in the following.

Figure 4:
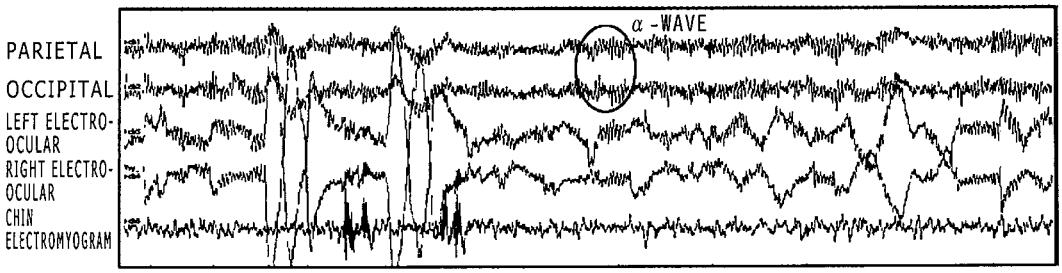
FIG. 4 is a diagram showing one example of the electroencephalogram, eye movement, and electromyogram of a subject in his or her closed-eye resting state, which are acquired by the electrodes of the wake-up assisting apparatus in FIG. 1.
Figure 5:
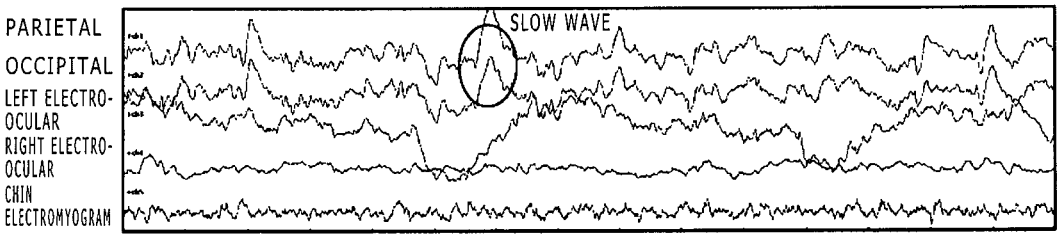
FIG. 5 is a diagram showing one example of the electroencephalogram, eye movement, and electromyogram of a subject in his or her deep sleep state, which are acquired by the electrodes of the wake-up assisting apparatus in FIG. 1.
Figure 6:
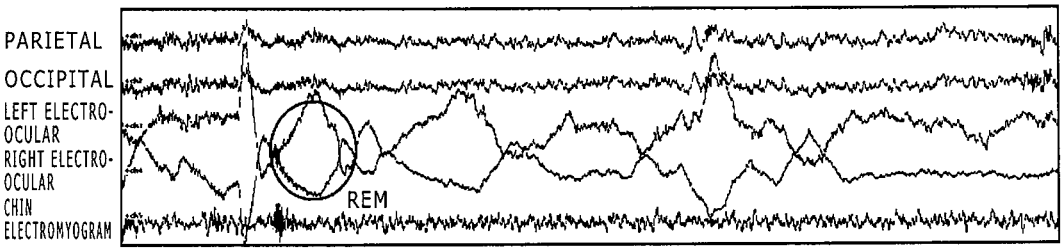
FIG. 6 is a diagram showing one example of the electroencephalogram, eye movement, and electromyogram of a subject in his or her REM sleep state, which are acquired by the electrodes of the wake-up assisting apparatus in FIG. 1.

As the wake-up assisting apparatus 1 mounted on the user's head is activated in Step St1, the parietal electrode 22 and the occipital electrode 23 acquire the user's EEG (showing brain waves), the right electro-ocular electrode 24 and the left electro-ocular electrode 25 acquire the user's EOG (showing eye movement), and the electrode 33 for chin electromyogram acquires the user's EMG. The brain waves, eye movement and electromyogram are collectively called the brain waves etc. hereinafter. FIGS. 4, 5, and 6 show brain waves etc. which are acquired by the parietal electrode 22, the occipital electrode 23, the right electro-ocular electrode 24, the left electro-ocular electrode 25, and the electrode 33 for chin electromyogram.

FIG. 4 shows the brain waves etc. which were recorded while the user was in closed-eye resisting state. The brain waves shown in FIG. 4 include the α-wave which is emitted when the brain is in an awaken state. FIG. 5 shows the brain waves etc. which were recorded while the user was in deep sleep state. The brain waves shown in FIG. 5 include the slow wave which is emitted when the brain is in a deep sleep state. FIG. 6 shows the brain waves etc. which were recorded while the user was in REM sleep state. The brain waves shown in FIG. 6 include the REM (Rapid Eye Movement) which is emitted when the brain is in a REM sleep state. In this way, the wake-up assisting apparatus 1 acquires characteristic brain waves, such as α-wave, spindle wave, K compound wave, slow wave, and REM wave, which are emitted in response to the state of brain activity. The thus recorded brain waves etc. are sent from each electrode to the signal processing part 41.

In Step St2, the signal processing part 41 determines "sleep stage." In other words, the signal processing part 41 detects features in the brain waves etc. periodically at prescribed intervals, thereby determining the sleep stage. FIG. 7 is a table showing the features (such as brain waves) which are used for determination of sleep stage by the signal processing part 41. Other features than shown in FIG. 7 may be used to determine the sleep stage. As shown in FIG. 7, the signal processing part 41 classifies the sleep state into six stages of "WAKE," "REM," and "Sleep Stages 1 to 4." The Wake Stage corresponds to non-sleep and Sleep Stages 1 to 4 correspond to non-REM sleep.

Figure 8:
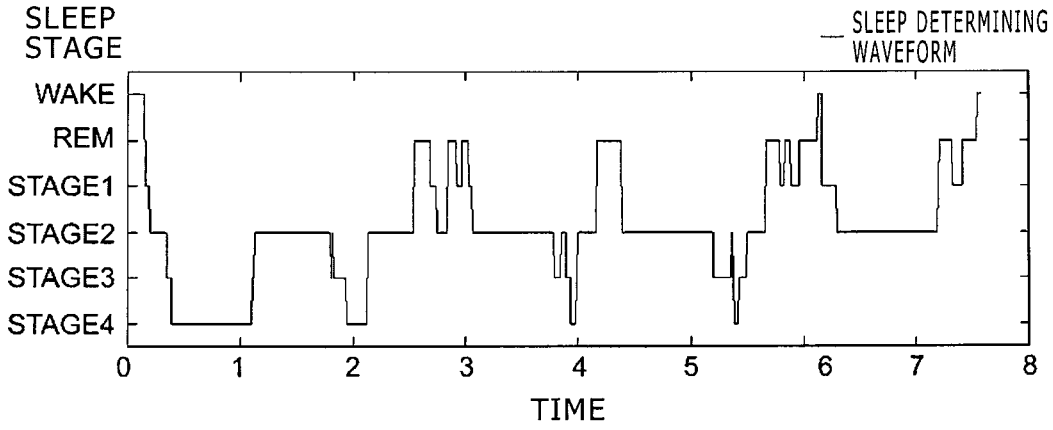
FIG. 8 is a graph showing one example of the sleep determining waveform obtained as the result of determination for sleep stage by the signal processing part of the wake-up assisting apparatus in FIG. 1.

FIG. 8 is a graph showing one example of the sleep determining waveforms obtained as the result of determination for sleep stage by the signal processing part 41. It is noted from FIG. 8 that the sleep stage determined from brain waves changes from "WAKE" to "Sleep Stage 4" in response to the user's sleep state.

Figure 9:
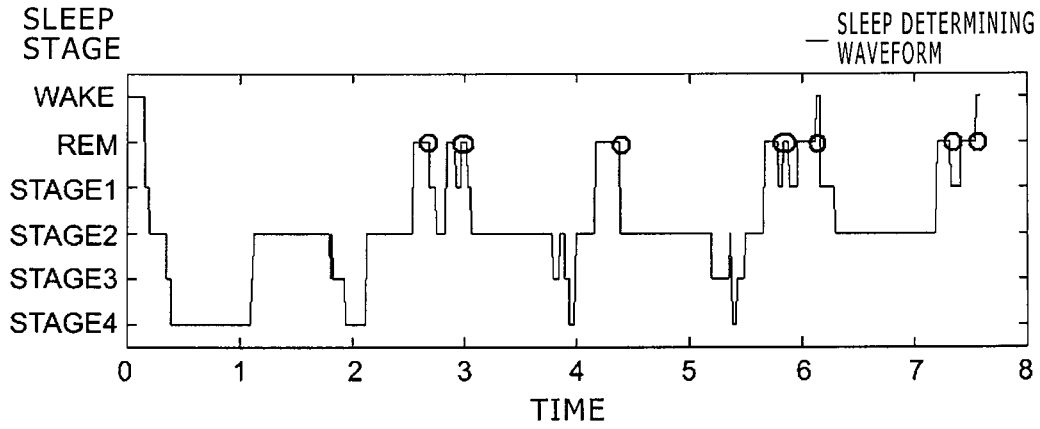
FIG. 9 is a conceptual diagram showing the candidates of the wake-up time which is set up by the signal processing part of the wake-up assisting apparatus in FIG. 1.

In Step St 3, the signal processing part 41 decides the "wake-up time." First, the signal processing part 41 sets up the candidates of wake-up time by means of the sleep determining waveforms as shown in FIG. 8. FIG. 9 is a conceptual diagram showing the candidates of wake-up time. As shown in FIG. 9, the signal processing part 41 selects the candidates of wake-up time from the times at which the REM sleep following deep sleep (sleep stages 2 to 4) ends. In FIG. 9, the candidates of wake-up time are marked with small circles.

In Step St4, the signal processing part 41 determines whether any one of the candidates of wake-up time coincides with the wake-up time. To be more specific, it calculates the difference between the candidate of wake-up time and the wake-up time (set up by the user). If the difference is within a previously established allowance, then the candidate of wake-up time is assigned as the wake-up time. In this way the signal processing part 41 decides the wake-up time so that the sleep time is longest before the wake-up time and the wake-up time coincides with the time at which the REM sleep ends. The signal processing part 41 sends the thus decided wake-up time to the stimulating part 28.

Figure 10A:
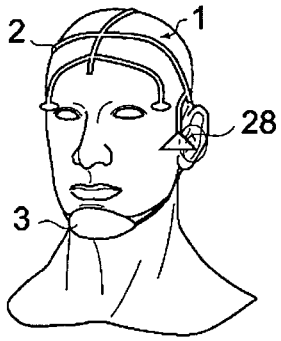
FIGS. 10A to 10C are schematic diagrams showing the action of the stimulating part of the wake-up assisting apparatus in FIG. 1.
Figure 10B:
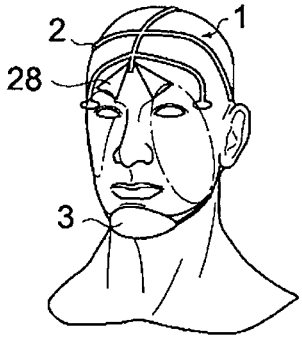
Figure 10C:
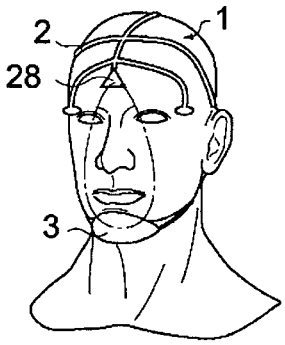

In Step St5, the stimulating part 28 gives stimuli to the user at the wake-up time. FIGS. 10A to 10C are schematic diagrams showing the action of the stimulating part 28. FIG. 10A shows that the stimulating part 28 gives stimuli to the user (to wake up him or her) by sounding an alarm. FIG. 10B shows that the stimulating part 28 blinks light on the user's eyes. FIG. 10C shows that the stimulating part gives off a fragrance near the user's nose. In the case of the wake-up assisting apparatus 1 shown in FIG. 1, the stimulating parts 28 are a pair of speakers that sound an alarm. The stimulating part 28 may be variously modified according to the type of stimuli to be given to the user.

As mentioned above, the wake-up assisting apparatus according to this embodiment determines the user's sleeping state according to his or her brain waves etc. It is capable of accurately determining the user's sleep state and wakes up the user at a time most suitable for his or her rising.

The following is a description of the second embodiment. Incidentally, identical structures as in the first embodiment are denoted by identical reference symbols without repeated explanation.

The wake-up assisting apparatus according to the second embodiment differs from the one according to the first embodiment in the arrangement of the signal processing part.

[Functional Structure of the Wake-Up Assisting Apparatus]

Figure 11:
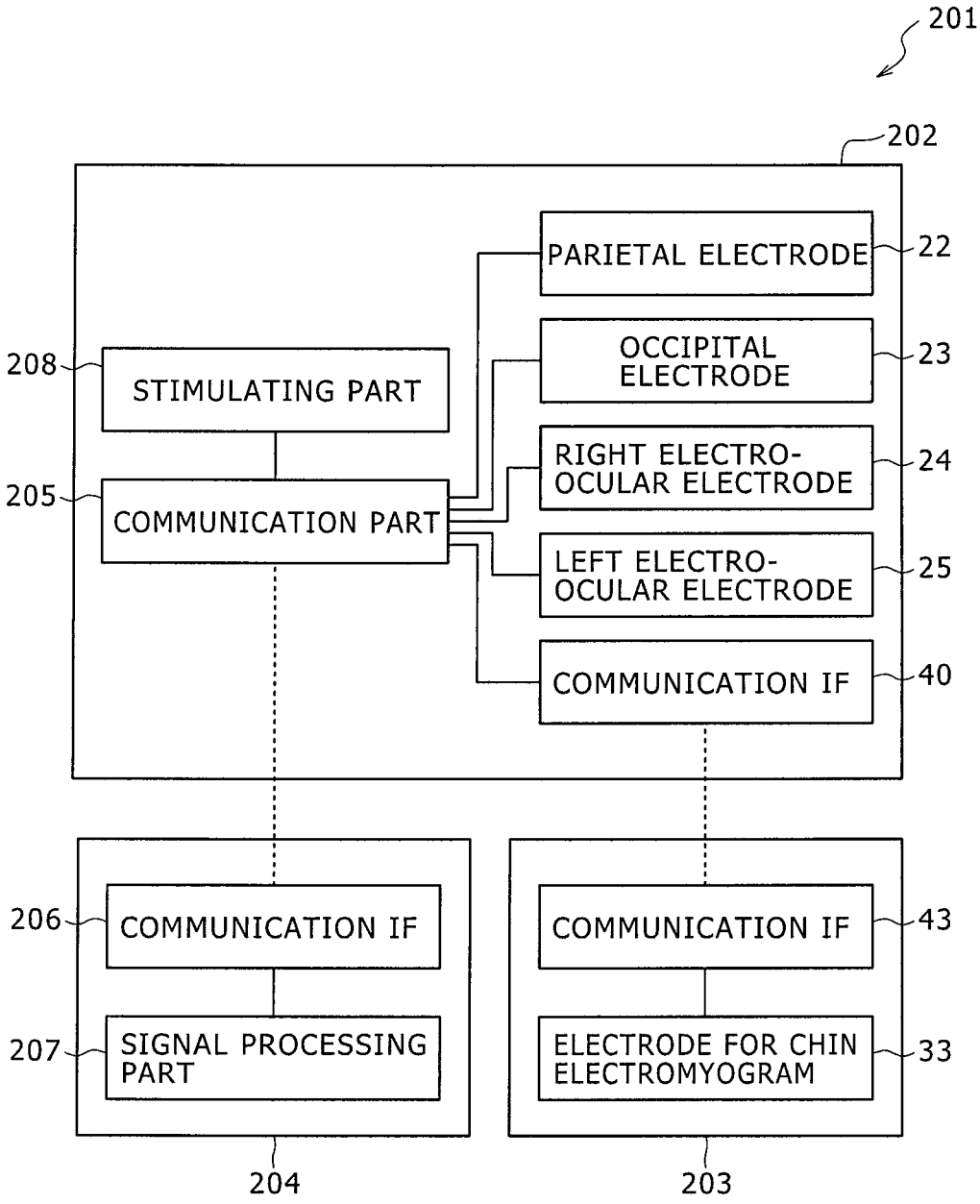
FIG. 11 is a block diagram showing the functional structure of the wake-up assisting apparatus according to the second embodiment.

FIG. 11 is a block diagram illustrating the functional structure of a wake-up assisting apparatus 201 according to this embodiment.

As shown in FIG. 11, the wake-up assisting apparatus 201 is composed of a head brace 202, a chin brace 203, and a signal processing unit 204.

The head brace 202 is provided with the parietal electrode 22, the occipital electrode 23, the right electro-ocular electrode 24, the left electro-ocular electrode 25, and the communication IF 40, as in the first embodiment, except that the signal processing part 41 is replaced by a communication part 205, which is connected to the stimulating part 208. The chin brace 203 is provided with the communication IF 43 and the electrode 33 for chin electromyogram, as in the first embodiment.

The signal processing unit 204 is provided with a communication IF 206 and a signal processing part 207, to which the communication IF 206 is connected. The signal processing unit 204 may be an information processing device such as personal computer.

The wake-up assisting apparatus 201 according to this embodiment is constructed such that the communication part 205 of the head brace 202 and the communication IF 206 of the signal processing unit 204 are connected to each other through a network such as the Internet.

[Action of the Wake-Up Assisting Apparatus]

The wake-up assisting apparatus 201 according to this embodiment works in the same way as the one according to the first embodiment, except that the signal processing part 207 of the signal processing unit 204 determines the sleep stage and decides the wake-up time. In other words, the electrode group acquires the user's brain waves etc., which are subsequently sent to the communication part 205. The communication part 205 sends the thus acquired brain waves etc. to the communication IF 206 of the signal processing unit 204 through the network.

The communication IF 206 sends the brain waves etc. to the signal processing part 207. The signal processing part 207 determines the user's sleep state and decides the wake-up time, in the same way as in the first embodiment. The signal processing part 207 sends the wake-up time to the communication part 205 of the head brace 202.

The communication part 205 sends the thus received wake-up time to the stimulating part 208. The stimulating part 208 gives stimuli in response to the wake-up time in the same way as in the first embodiment.

According to this embodiment, the signal processing part 207 which determines the sleep state and decides the wake-up time is mounted on the signal processing unit 204 which is separate from the head brace 202. This helps reduce the weight of the head brace 202. Moreover, this permits one signal processing unit 204 to be shared by more than one head brace 202.

The following is a description of the third embodiment. Incidentally, identical structures as in the first embodiment are denoted by identical reference symbols without repeated explanation.

The wake-up assisting apparatus according to the third embodiment differs from the one according to the first embodiment in the arrangement of the signal processing part and the stimulating part.

[Functional Structure of the Wake-Up Assisting Apparatus]

Figure 12:
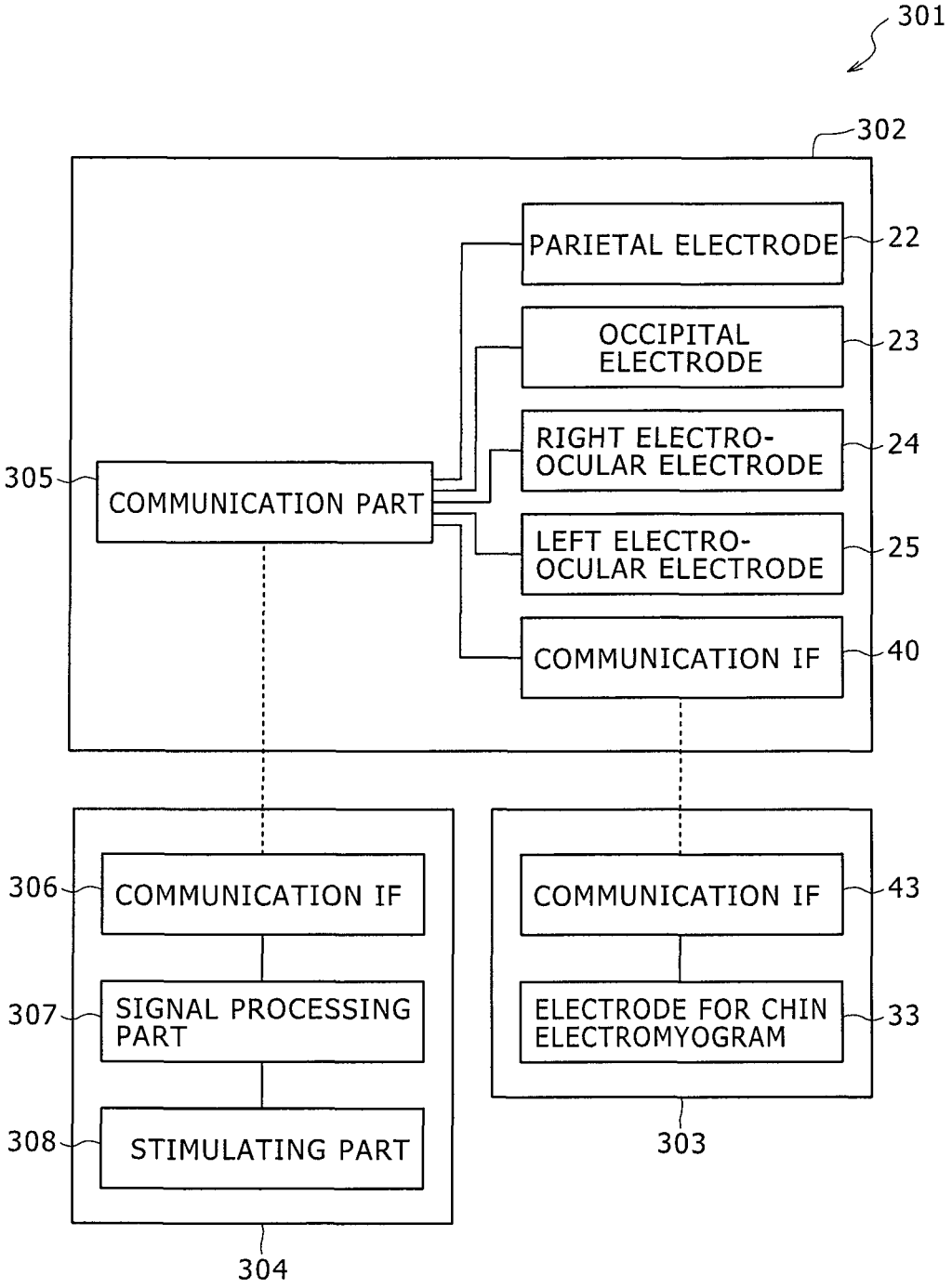
FIG. 12 is a block diagram showing the functional structure of the wake-up assisting apparatus according to the third embodiment.

FIG. 12 is a block diagram illustrating the functional structure of a wake-up assisting apparatus 301 according to this embodiment.

As shown in FIG. 12, the wake-up assisting apparatus 301 is composed of a head brace 302, a chin brace 303, and a stimulating unit 304.

The head brace 202 is provided with the parietal electrode 22, the occipital electrode 23, the right electro-ocular electrode 24, the left electro-ocular electrode 25, and the communication IF 40, as in the first embodiment, except that the signal processing part 41 is replaced by a communication part 305. The chin brace 303 is provided with the communication IF 43 and the electrode 33 for chin electromyogram, as in the first embodiment.

The stimulating unit 304 is provided with a communication interface 306, a signal processing part 307, and a stimulating part 308. The stimulating part 308 is connected to the signal processing part 307, and the signal processing part 307 is connected to the communication IF 306. The stimulating unit 304 is a unit to be mounted on the user separately from the head brace 302 and the chin brace 303.

The wake-up assisting apparatus 301 according to this embodiment is constructed such that the communication part 305 of the head brace 302 and the communication IF 306 of the stimulating unit 304 are connected to each other through the communication means such as wireless communication.

[Action of the Wake-Up Assisting Apparatus]

The wake-up assisting apparatus 301 according to this embodiment works in the same way as the one according to the first embodiment, except that the signal processing part 307 of the stimulating unit 304 determines the sleep stage and decides the wake-up time. In other words, the electrode group acquires the user's brain waves etc., which are subsequently sent to the communication part 305. The communication part 305 sends the thus acquired brain waves etc. to the communication IF 306 of the stimulating unit 304 through the network.

The communication IF 306 sends the brain waves etc. to the signal processing part 307. The signal processing part 307 determines the user's sleep state and decides the wake-up time, in the same way as in the first embodiment. The signal processing part 307 sends the wake-up time to the stimulating part 308. The stimulating part 308 gives stimuli to the user at the wake-up time, as in the case of the first embodiment.

The wake-up assisting apparatus according to this embodiment is constructed such that the signal processing part 307 which determines the sleep stage and decides the wake-up time and the stimulating part 308 are mounted on the stimulating unit 304 separate from the head brace 302. This helps reduce the weight of the head brace 302. Moreover, this permits the stimulating part 308 to be separated from the head brace 302, so that the stimulating part 308 can be positioned more freely than in the case of the first and second embodiments.

The present disclosure is not restricted by the embodiments mentioned above but may be modified and changed variously within the scope thereof.

According to the foregoing embodiments, the signal processing part determines the user's sleep state; however, this may be changed such that a specialist such as doctor determines the user's sleep state from the brain waves displayed on the wake-up assisting apparatus.

The wake-up assisting apparatus according to the foregoing embodiments determines the sleep stage from the brain waves, eye movement, and chin electromyogram. However, it may determine the sleep stage by using part of them or any other information of living body.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A wake-up assisting apparatus comprising:

an electrode which comes into contact with a parietal of a human body;

a signal processing part which detects brain waves through said electrode, determines a sleep stage from the thus detected brain waves, and decides a wake-up time according to the sleep stage; and a stimulating part which gives stimuli to the human body at the wake-up time, wherein said signal processing part assigns a time at which a REM sleep stage ends as the wake-up time.

2. The wake-up assisting apparatus as defined in claim 1, wherein said signal processing part sets up the time at which the REM sleep stage ends as candidates for the wake-up time and assigns one of the candidates which is closest to a previously established wake-up time as the wake-up time.

3. The wake-up assisting apparatus as defined in claim 2, wherein said electrode and said signal processing part are attached to a head gear configured to be mounted on the head of the human body.

4. The wake-up assisting apparatus as defined in claim 2, further comprising:

a communication part which sends said brain waves to said signal processing part and receives said wake-up time from said signal processing part, wherein said electrode, said communication part, and said stimulating part are attached to a head gear configured to be mounted on the head of the human body.

5. The wake-up assisting apparatus as defined in claim 2, further comprising:

a communication part which sends said brain waves to said signal processing part, wherein said electrode and said communication part are attached to a head gear configured to be mounted on the head of the human body.

6. The wake-up assisting apparatus as defined in claim 1, wherein the sleep state is determined to be at least one of REM sleep and non-REM sleep.

7. A wake-up assisting method comprising:

bringing an electrode into contact with a head of a human body;

the signal processing part determining a sleep stage based on information of brain waves detected through said electrode and deciding a wake-up time based on the sleep stage; and a stimulating part giving stimuli to the human body at the wake-up time, wherein said signal processing part assigns a time at which a REM sleep stage ends as the wake-up time.

* * * * *